US006438795B1

(12) United States Patent
Haab et al.

(10) Patent No.: US 6,438,795 B1
(45) Date of Patent: Aug. 27, 2002

(54) BUFFER DEVICE

(75) Inventors: Karl Haab, Weggis; Otto Haab, Mettmenstetten, both of (CH)

(73) Assignee: Hawa AG, Mettmenstetten (CH)

( * ) Notice: Subject to any disclaimer, the term of this patent is extended or adjusted under 35 U.S.C. 154(b) by 0 days.

(21) Appl. No.: 09/673,171

(22) PCT Filed: Mar. 14, 2000

(86) PCT No.: PCT/CH00/00145

§ 371 (c)(1),
(2), (4) Date: Oct. 12, 2000

(87) PCT Pub. No.: WO00/55460

PCT Pub. Date: Sep. 21, 2000

(30) Foreign Application Priority Data

Mar. 16, 1999 (CH) ..... 481/99

(51) Int. Cl.[7] ..... E05F 5/06

(52) U.S. Cl. ..... 16/85; 16/86 B; 16/87.6; 49/424

(58) Field of Search ..... 16/85, 86 R, 86 A, 16/86 B, 87.6, 93 R; 49/424, 428, 457, 444, 441, 449

(56) References Cited

U.S. PATENT DOCUMENTS 1,768,267 A * 6/1930 Phillips
3,536,120 A * 10/1970 Kellems
5,085,261 A * 2/1992 Bortoluzzi
5,450,693 A * 9/1995 Tarrega
6,052,867 A * 4/2000 Haab et al.
6,253,417 B1 * 7/2001 Rusiana

FOREIGN PATENT DOCUMENTS

| | | | |
|---|---|---|---|
| CH | 657 415 | A | 9/1986 |
| DE | 196 12 125 | A | 11/1996 |
| EP | 0 444 378 | A | 9/1991 |
| EP | 0 502 285 | A | 9/1992 |
| EP | 0 733 766 | A | 9/1996 |

* cited by examiner

*Primary Examiner*—Anthony Knight
*Assistant Examiner*—Mark Williams
(74) *Attorney, Agent, or Firm*—Oliff & Berridge, PLC

(57) ABSTRACT

The buffer device (10) has a body (11) which can be fitted in a rail (4), a damping element (12) for cushioning, and a retaining spring (13) for retaining a running mechanism (6) which is guided in the rail (4) and is provided for carrying and guiding slidable wing elements (2). The at least approximately U-profile-shaped body (11) of the buffer device (10), which body is punched and bent from a metal element, has a first and a second wing (14; 18), which wings are connected to each other by a central piece (20) whose tongue-shaped extension forms the retaining spring (13) serving to retain the running mechanism (6). The end pieces (17, 19, 26; 17*, 19*) of the wings (14; 18) are configured in such a manner that they are suitable for retaining the damping element (12). The buffer device (10) can be manufactured cost-effectively from a single metal plate and can be completed by a damping element (12). Since the retaining spring (13) is a component part of the body (11) of the buffer device (10), the device is highly stable.

9 Claims, 4 Drawing Sheets

BUFFER DEVICE

FIELD OF INVENTION

The invention relates to a buffer device for running mechanisms guided in rails with a damping element for cushioning and a retaining spring for retaining a running mechanism guided on the rail.

Foldable or slidable room dividers for dividing rooms, as depicted in FIG. 8 (see also WO 96/21788), have at least one displaceable door element which is connected to at least one further door element, generally by means of hinges, and is retained and guided rotatably on one door side in an upper running rail and a lower running or guide rail. FIG. 8 shows, by way of example, a room opening which can be closed by means of a door 201 and three door elements 2, 2', 2" which are connected to one another via three hinges 209 in each case and can be folded relative to one another. As seen from the first door element 2, in folding doors normally every other door element 2, 2", . . . is suspended and guided at the bottom. The door elements 2 and 2" are therefore guided at the top in a running rail 4 and at the bottom in a guide groove 208. The door elements 2, 2', 2" can consequently be displaced along the rail 4 while folded together.

DESCRIPTION OF RELATED ART

In order to guide the door elements 2, 2', 2", use is made, for example, of rails 4 and running mechanisms 6, as shown in FIG. 9 and disclosed in EP 0 733 766 A1. The rail 4, which is fastened to a wall 206 by means of a clip 211 and two screws 212, 213, has a downwardly open U-profile with feet pieces 402 along whose running surfaces 5 the wheels 8 of the running mechanism 6 roll.

FIG. 1 shows the rail 4 and the running mechanism 6 in the section A—A illustrated in FIG. 9. A door element 2 is connected to the running mechanism 6 by means of a fitting assembly comprising a securing means 3 and a connecting screw 1. The securing means 3 is connected to the door element 2 by four screws. The connecting screw 1, which is mounted rotatably in the securing means 3, is screwed into a thread 9 provided in the body 7 of the running mechanism 6.

FIG. 1 furthermore shows a known buffer device 100 which has a body 101 which is connected to a damping element 102 and a retaining spring 103. The buffer device 100 serves for the controlled stopping of the running mechanism 6 if the door element 2 is guided as far as the stop. This prevents the door element 2 from striking against the frame 202. The first door element 2 is frequently to be retained on the stop or in the frame, so that the further door elements 2', 2", . . . can be unfolded in order to close the opening. In order to retain the door element 2 or the running mechanism 6 which -corresponds t is made of the retaining spring 103 which has been connected to the body 101 of the buffer device 100. If the running mechanism 6 runs up against the buffer device 100 or the damping element 102, the retaining spring 103 is run up on a cam 29 arranged in the form of a ramp on the running mechanism body 7, and snaps in behind it as soon as the running mechanism 6 contacts against the damping element 102.

The buffer device 100 which is shown comprises, as described above, a plurality of parts and has consequently to be produced and assembled with considerable outlay in various operations. The connection between the retaining spring 103 and the body 101 is regularly subjected to the action of a considerable force, which is why wear phenomena and deficient operational capability may occur prematurely.

The door element 2 is held firmly against a stop by the retaining spring 103 and can only be made to move again by the action of a force. The retaining force exerted by the retaining spring 103 may be too low or too high, depending on the application.

There is therefore fundamentally a relatively high outlay on maintenance in these known devices. Furthermore, the installation procedure is associated with a not inconsiderable outlay. This is because in order to instal the buffer device drill-holes have to be provided in the rail 4, through which drill-holes screws are guided which are connected to the buffer device.

SUMMARY OF THE INVENTION

The present invention is therefore based on the object of providing a cost-effective and stable buffer device which can be fitted in a simple manner and enables a door element which is mounted in a displaceable manner to be cushioned while running and to be retained in a designated position.

This object is achieved by a buffer device with an approximately U-profile-shape body with a damping element for cushioning and a retaining spring for retaining a running mechanism which is guided on a rail. The body is punched from a metal element and has a tongue-shaped extension and a first wing piece and a second wing piece. The tongue-shaped extension forms a retaining spring for retaining a running mechanism. The two wing-shaped pieces retain the damping element. Further advantageous refinements of the invention are discussed below.

The buffer device according to the invention, which can be fitted in a convenient manner with little outlay, enables running mechanisms which are connected to displaceable door elements to be cushioned while running and to be retained in a designated position in such a way that a flush connection of the first door element to the frame is assured as being maintained while door elements are being opened and closed. Only by a relatively powerful pulling movement can the first door element be detached again from the buffer device and slid away. The buffer device can be manufactured cost-effectively from a single metal plate and can be completed by a damping element. Since the retaining spring is preferably a component part of the body of the buffer device, in addition to the outlay on production being reduced the device is highly stable. Furthermore, the retaining spring can be produced separately from the body of the buffer device, which body is formed according to the invention, and can subsequently be connected to said body in a non-positive manner, preferably by rivets or screws.

In a preferred refinement of the invention, the retaining spring can optionally be prestressed, allowing the force with which the door element 2 is retained against the stop to be adjusted.

BRIEF DESCRIPTION OF THE DRAWINGS

In the following, the invention is explained in more detail with reference to a drawing, in which.

DETAILED DESCRIPTION OF PREFERRED EMBODIMENTS

Figure 8:
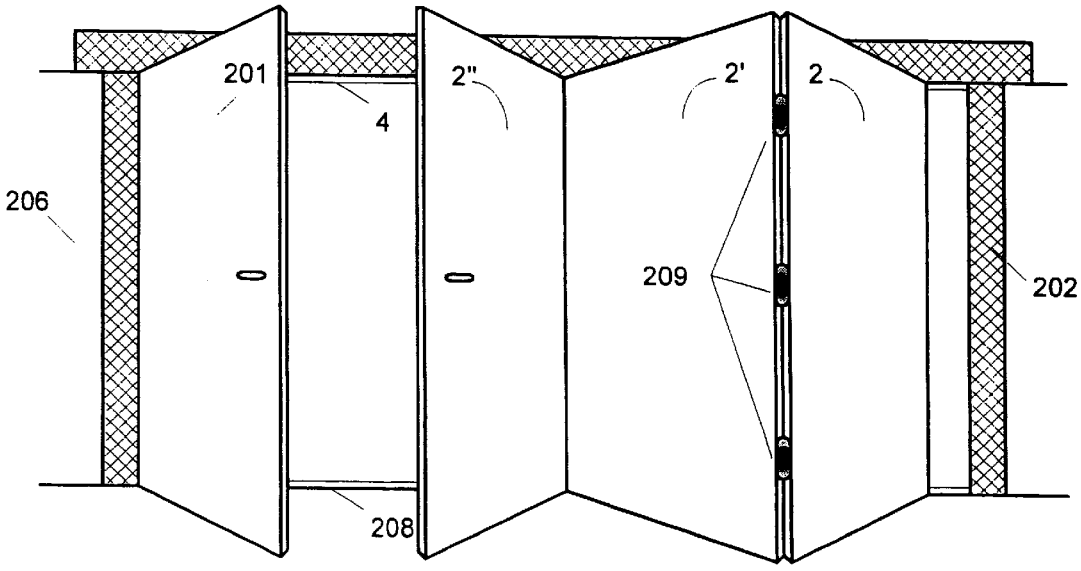
FIG. 8 shows the folding walls which are described at the beginning and comprise a plurality of door elements 2, 2', 2"
Figure 9:
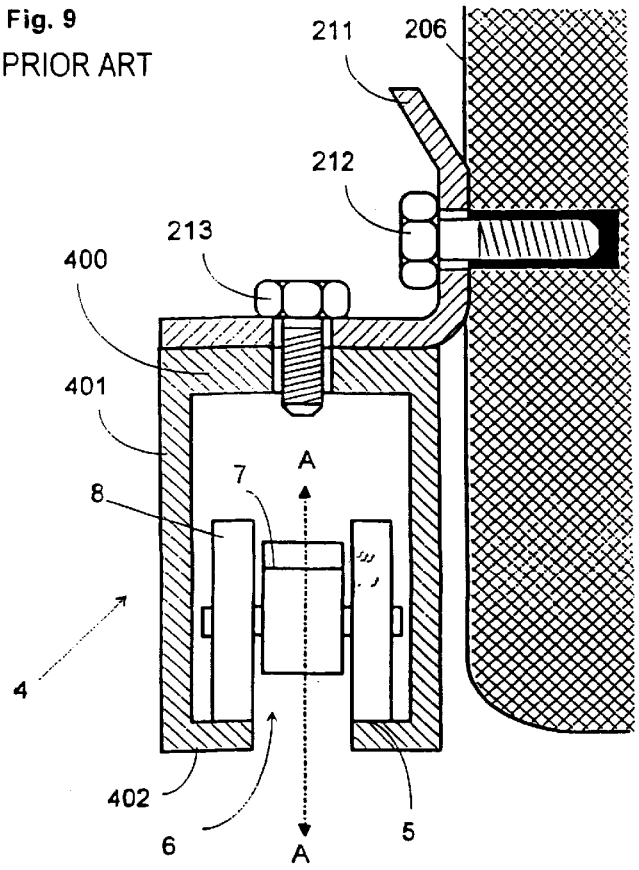
Fig. 9 PRIOR ART
FIG. 9 shows a rail 4 which is fitted on a wall and is suitable for accommodating the buffer device 10 according to the invention.

FIG. 8 shows the folding walls which are described at the beginning and comprise a plurality of rotatable and displaceable door elements 2, 2', 2". The door elements 2, 2', 2" are guided by running mechanisms 6 in rails 4, as are shown in FIG. 9. The U-profile-shaped rail 4, which is fastened to a wall 206 by means of a clip 211 and two screws 212, 213, has an upper rail central piece 400 which is connected on both sides to side plates 401 whose ends have pieces 402 which are directed toward one another and have running surfaces 5 along which the wheels 8 of the running mechanism 6 roll.

Figure 1:
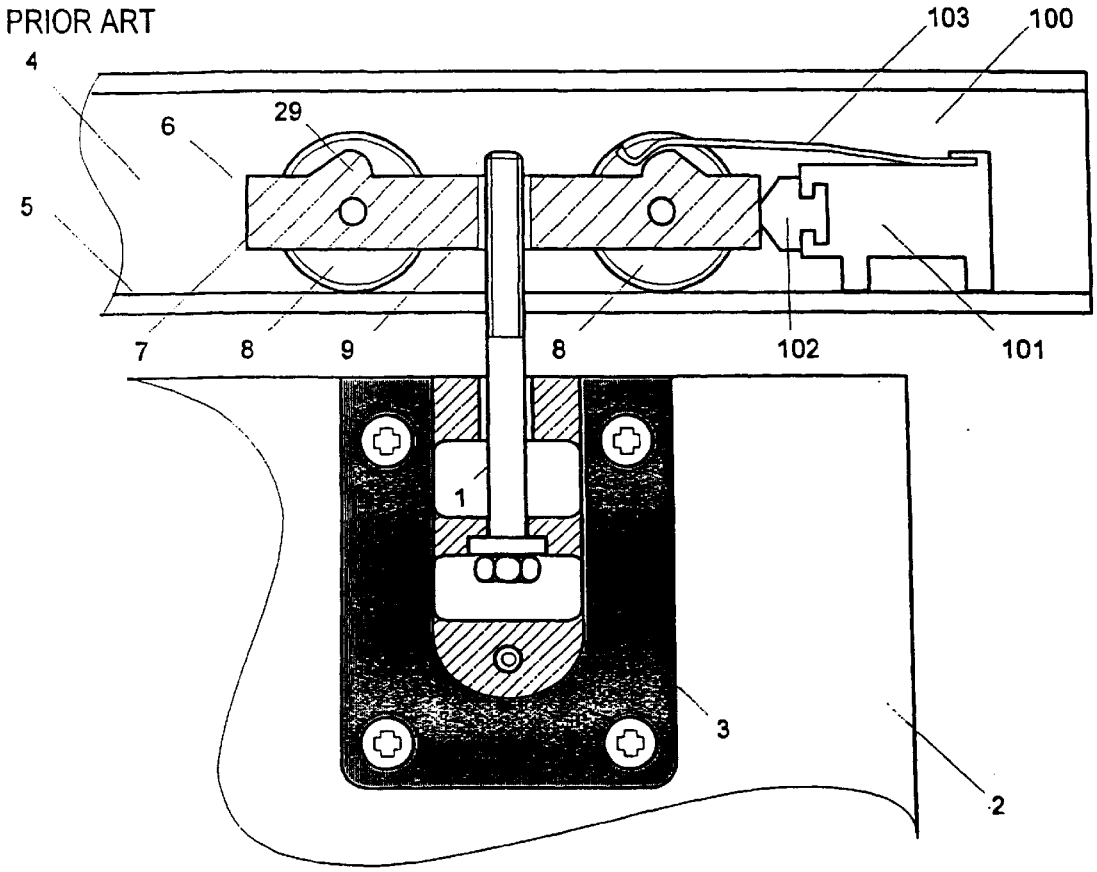
Fig. 1 PRIOR ART
FIG. 1 shows the known buffer device 100 installed in a rail 4 in which a running mechanism 6, which is connected to a door element 2, is guided.
Figure 6:
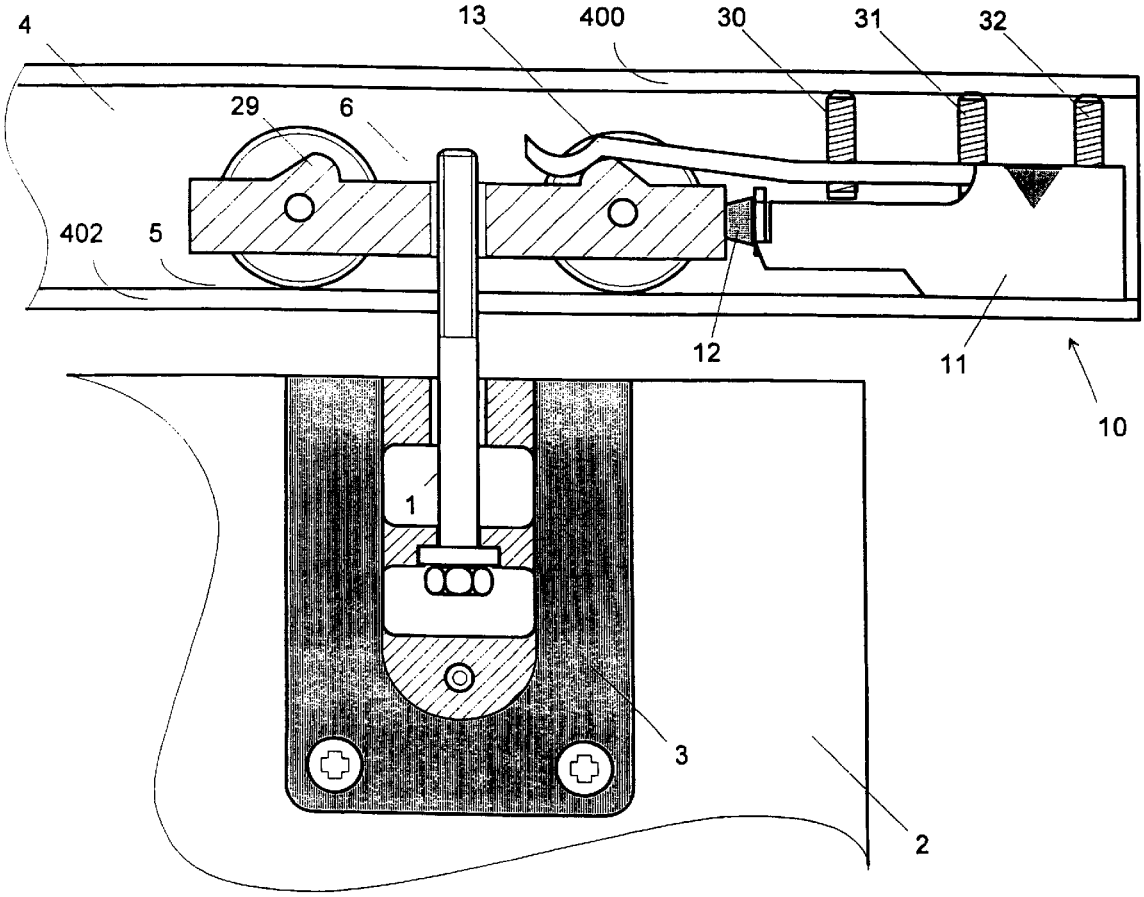
FIG. 6 shows the buffer device 10 according to the invention, installed in a rail 4 in which a running mechanism 6, which is connected to a door element 2, is guided.

FIGS. 1 and 6 show the rail 4 and the running mechanism 6 in the section A—A illustrated in FIG. 9. A door element 2 is connected to the running mechanism 6 by means of a fitting system comprising a securing means 3 and a connecting screw 1. The securing means 3 is fastened to the door element 2 by four screws. The connecting screw 1, which is mounted rotatably in the securing means 3, is screwed into a thread 9 provided in the body 7 of the running mechanism 6. FIG. 1 shows the buffer device 100 described at the beginning. FIG. 6 shows a buffer device 10 according to the invention which is installed in the rail 4 and is described in detail in the following.

Figure 7:
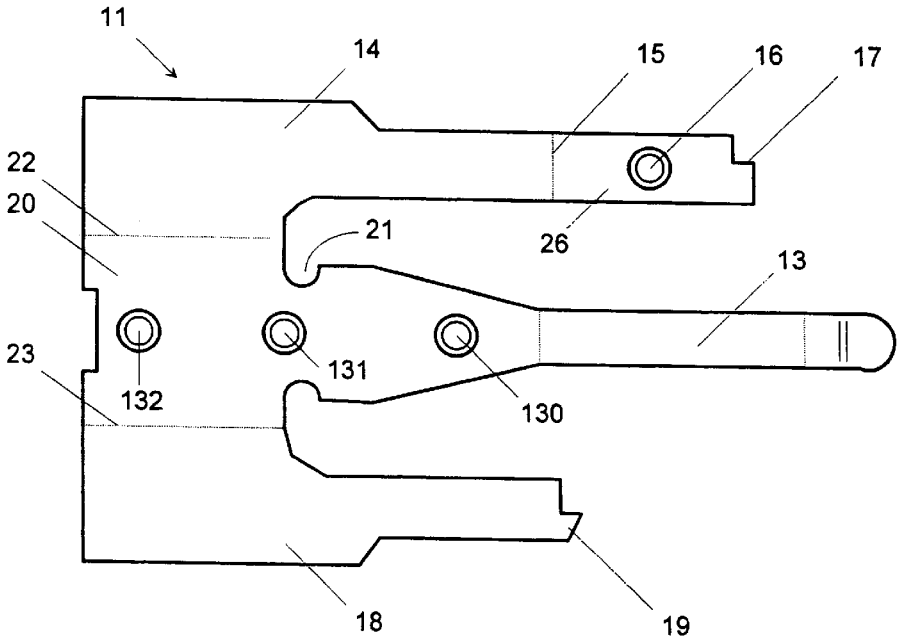
FIG. 7 shows the body 11 of the buffer device 10 according to the invention, which body is punched from a metal sheet and is not yet bent.

FIG. 7 shows the body 11 of the buffer device 10, which body is punched from sheet metal and is not yet bent. The body 11 comprises a central piece 20 which is connected on one side to a first wing 14 and on the other side to a second wing 18. After the bending procedures are finished, the extension of the central piece 20 forms a retaining spring 13 which is preferably of narrower design than the central piece 20.

Rounded zones 21 are preferably provided on both sides of the transition from the retaining spring 13 to the central piece 20, which zones ensure that bending stresses are distributed there, which avoids premature material fatigue at these points.

Two threaded drill-holes 131 and 132, which serve to receive fastening screws 31, 32 (see FIG. 2), are furthermore provided in the central piece 20. A further threaded drill-hole 130 is provided in the extension of the central piece 20, which drill-hole serves to receive an adjusting screw-30 by means of which the retaining spring 13 can be prestressed.

The end piece of the first wing 14 has a front piece 26 which is provided with an opening 16 provided to receive the damping element 12. The first and second wings 14, 18 also have end pieces 17 and 19, respectively, which overlap one another after the bending procedures (see FIGS. 2–4).

After the body 11 of the buffer device, as shown in FIG. 7, has been punched from a metal sheet, the bending procedure can proceed as follows. First of all, the retaining spring 13 is bent taking the required prestress and the shape of the running mechanism body 7 to be retained (see cam 29) into consideration. Subsequently, the front piece 26, then the first wing 14 and then the second wing 18 are bent at least approximately perpendicularly downward along bending lines 15, 22 and 23, in such a manner that the end pieces 17 and 19 of the two wings 14 and 18, respectively, overlap one another (see FIG. 2). After that, the adjusting screw 30, the fastening screws 31, 32 and the damping element 12 are inserted.

Figure 2:
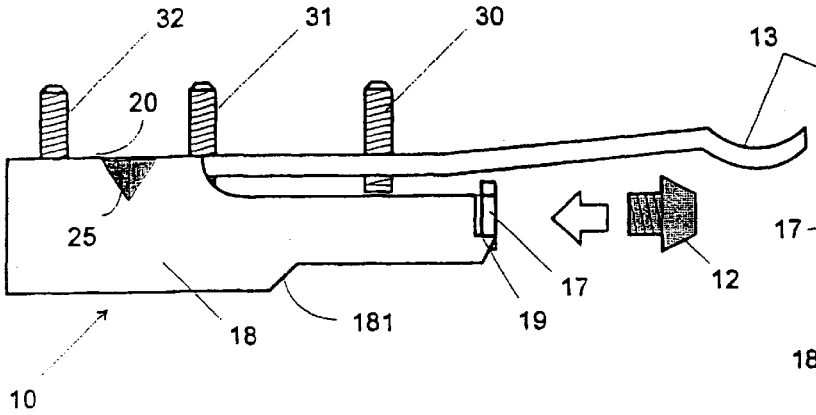
FIG. 2 shows a side view of the buffer device 10 according to the invention.
Figure 3:
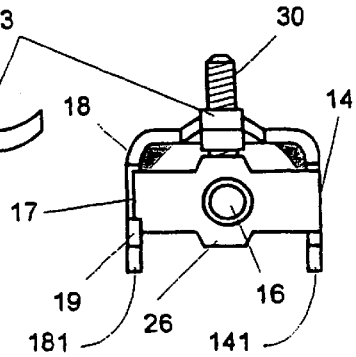
FIG. 3 shows the buffer device 10 according to FIG. 2 from the front.

In order to reinforce the buffer device 10, there are preferably additionally pressed into the body 11 the notches 25 which are shown in FIGS. 2 and 3 and by means of which the two wings 14 and 18 and the central piece 20 are mutually stabilized. The notches 25 can be inserted, for example, by means of a wedge which is guided relative to the wing 14 or 18 and the central part 20 at an angle of 450 with respect to the body 11. The mutual stabilization of the wilds 14, 18 and of the central piece 20 prevents the central piece 20 from buckling during installation of the fastening screws 31, 32, which would result, on the one hand, in the adjustment of the retaining spring 13 changing and, on the other hand, in the buffer device 10 being insufficiently fastened in the rail 4.

FIG. 3 shows the buffer device 10 from the front. The front piece 26, which serves to hold the damping element 12, connects the two wings 14 and 18 in such a manner that an impact on the front piece 26 is absorbed in each case by both wings 14 and 18. The adjusting spring 30, which serves to adjust the retaining spring 13, is also shown.

It can furthermore be seen from FIG. 2 and FIG. 3 that the two wings 14 and 18 are provided on the front side with recesses 141 and 181, respectively, which enable the buffer device 10 to tilt forward after it has been introduced into the rail 4. This may be necessary if the running rail is fastened with screws whose head height or head shape prevents the buffer device 10 from being pushed through. When the running rail is fitted, the running mechanism 6 and the buffer device 10 have already been inserted in the running rail in the correct sequence. The recesses 141 and 181 then make it possible for the buffer device 10 to be able to be tilted at a constriction caused, for example, by the head of a fastening screw, and slid past the corresponding point.

Figure 4:
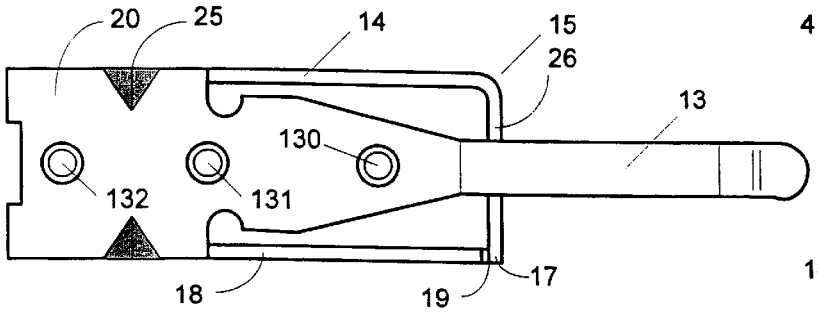
FIG. 4 shows the buffer device 10 according to FIG. 2 from above.

FIG. 4 shows the buffer device 10 from above. The notches 25 which serve to reinforce the buffer device 10 can readily be seen. It can furthermore be seen how the front piece 26 is bent toward the second wing 18 and overlaps the latter at the end.

Figure 10:
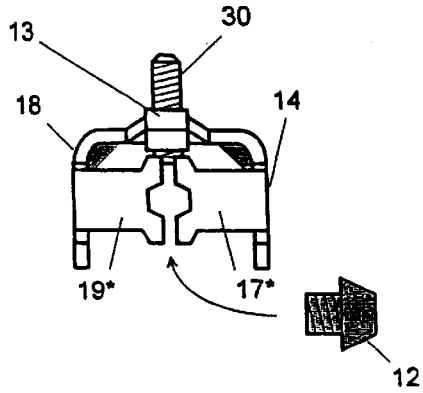
FIG. 10 shows wing end pieces 17*, 19*, which are provided for retaining the damping element 12 on both sides.

As shown in FIG. 10, it would also be possible to configure the end pieces 17* and 19* of the wings 14, 18 and bend them toward one another in such a manner that they clamp the damping element 12 in the center. However, in this case the quality of retention of the damping element 12 is dependent on the precision of the bending procedures and not on the quality of a drill-hole 16 which can be provided in a precise manner in the front piece 26.

Figure 5:
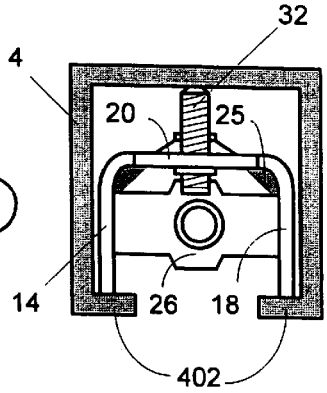
FIG. 5 shows the buffer device 10 according to FIG. 2 installed in a rail 4, from the rear.

FIG. 5 shows the buffer device 10 which is installed in a rail 4, from the rear. It can be seen from this that the two wings 14, 18 rest on the foot pieces 402 of the rail 4 and, respectively, on the running surfaces 5 for the rollers 8. The screws 31 and 32 are rotated upward sufficiently far with respect to the rail central piece 400 that the buffer device is firmly clamped between the rail central piece 400 and the foot pieces 402. The central piece 20, which is pressed downward by the fastening screws 31, 32, is supported by the notches 25.

FIG. 6 shows the buffer device 10 according to the invention, installed in a rail 4 in which a running mechanism 6, which is connected to a door element 2, is guided. The running mechanism 6 bears against the damping element 12 and is retained in the position shown by the retaining spring 13, which is guided via the cam 29 provided on the running mechanism body 7. So that the running mechanism 6 can be detached again from the retaining spring 13, a pulling force has to be applied by means of which the retaining spring 13 is again raised above the cam 29. In order to adjust the force with which the running mechanism 6 is retained against its stop, the retaining spring 13 can be prestressed as required. For this purpose, a threaded drill-hole 130 is provided in the extension of the central piece 20, which drill-hole serves to receive an adjusting screw 30 which is rotated a sufficient amount with respect to said central piece until the retaining spring 13 is pressed downward to a sufficiently great extent.

Of course, the buffer device 10 according to the invention can advantageously be used with different types of rails and running mechanisms. In a more simple refinement, the adjusting screw 30 may be omitted. In principle, another means of installation in the rail 4 may also be selected, for example the wings 14 and/or 18 could be directly screwed to the rail 4.

Figure 11:
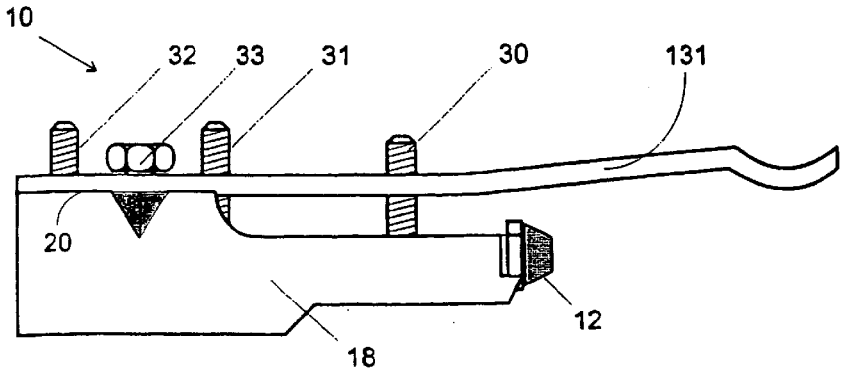
FIG. 11 shows a buffer device 10 according to the invention whose retaining spring 131 is connected to the body 11 by a screw 33.

FIG. 11 shows a buffer device 10 according to the invention whose retaining spring 131 is connected non-positively to the body 11 manufactured in accordance with the invention. The connection may, as shown in FIG. 11, be undertaken by a screw 33, and also by a rivet or further connecting means. This measure is expedient particularly if a particular spring steel which is not suitable for the production of the body 11 is requested for the production of the retaining spring 131.

Rotation of the adjusting screw 30 with respect to the rail central piece 400 causes the buffer device 10 additionally to be retained within the rail 4 and to be secured against displacement when cushioning a door element 2, 2', 2". In this arrangement, the use of one of the fastening screws 31, 32 may be omitted under some circumstances.

What is claimed is:

1. A buffer device with a body fitted in a rail, a damping element for cushioning, and a retaining spring for retaining a running mechanism which is guided in the rail and is provided for carrying and guiding slidable wing elements, wherein the body is at least approximately U-profile-shaped, which body is punched and bent from a metal element, has a first and a second wing, which wings are connected to each other by a central piece which has a tongue-shaped extension that forms a retaining spring serving to retain the running mechanism, and wherein the end pieces of the wings are provided to retain the damping element.

2. The buffer device as claimed in claim 1, wherein the end pieces of the wings are bent toward one another and retain the damping element therebetween.

3. The buffer device as claimed in claim 1, wherein threaded drill-holes for fastening screws are provided in the central piece, wherein the body can be fitted in a U-profile-shaped rail which has an upper rail central piece which is connected on both sides to side plates whose ends have foot pieces directed toward one another, in which case the two wings can be placed onto the foot pieces and the fastening screws are rotatable with respect to the rail central piece.

4. The buffer device as claimed in claim 4, wherein a threaded drill-hole for an adjusting screw is provided in the central piece or the extension thereof, which adjusting screw is rotatable with respect to the rail central piece in order to adjust a prestress for the retaining spring.

5. The buffer device as claimed in claim 1, wherein notches are impressed in the body, which notches serve to reinforce the buffer device.

6. The buffer device as claimed in claim 1, wherein at the front on the lower side the two wings are provided with recesses which enable the buffer device introduced into the rail to tilt.

7. The buffer device as claimed in claim 1, wherein the end pieces of the two wings which are bent toward one another mutually overlap.

8. The buffer device as claimed in claim 3, wherein threaded drill-holes (131, 132) for fastening screws (31, 32) are provided in the central piece (20), wherein the body (11) can be fitted in a U-profile-shaped rail (4) which has an upper rail central piece (400) which is connected on both sides to side plates (401) whose ends have foot pieces (402) directed toward one another, in which case the two wings (14, 18) can be placed onto the foot pieces (402) and the fastening screws (31, 32) are rotatable with respect to the rail central piece (400).

9. The buffer device as claim 1, wherein the first wing has a front piece which is bent toward the second wing and is provided with an opening that receives the damping element.

* * * * *